US005754108A

United States Patent [19]

Ungarsohn

[11] Patent Number: 5,754,108

[45] Date of Patent: May 19, 1998

[54] UNIVERSAL ALARM SYSTEM

[76] Inventor: Benjamin I. Ungarsohn, 2911 Charlotte Dr., Merrick, N.Y. 11566

[21] Appl. No.: 642,197

[22] Filed: May 6, 1996

[51] Int. Cl.[6] ..... G08B 13/14

[52] U.S. Cl. ..... 340/568; 340/571; 340/686; 340/687

[58] Field of Search ..... 340/568, 571, 340/427, 687, 686

[56] References Cited

U.S. PATENT DOCUMENTS

| | | | |
|---|---|---|---|
| 5,191,314 | 3/1993 | Ackerman et al. | 340/571 |
| 5,345,221 | 9/1994 | Pons et al. | 340/571 |
| 5,408,213 | 4/1995 | Ungarsohn | 340/427 |

*Primary Examiner*—Glen Swann
*Attorney, Agent, or Firm*—Richard L. Miller, P.E

[57] ABSTRACT

A universal alarm system includes a first main component and a second main component. The first main component contains an internally-disposed continuous loop alarm circuit and is attachable to a first object that is to be protected against an unauthorized removal thereof. The second main component replaceably engages the first main component, by non-magnetic means, and contains an internally-disposed circuit and is attachable to a second object. The internally-disposed continuous loop alarm circuit of the first main component is in electrical communication with the internally-disposed circuit of the second main component when the first main component is engaged with the second main component, so that when the first main component and the second main component are separated from each other the internally-disposed continuous loop alarm circuit of the first main component activates an alarm and since the first main component remains with the first object, location of the first object is facilitated.

27 Claims, 1 Drawing Sheet

FIG. 1
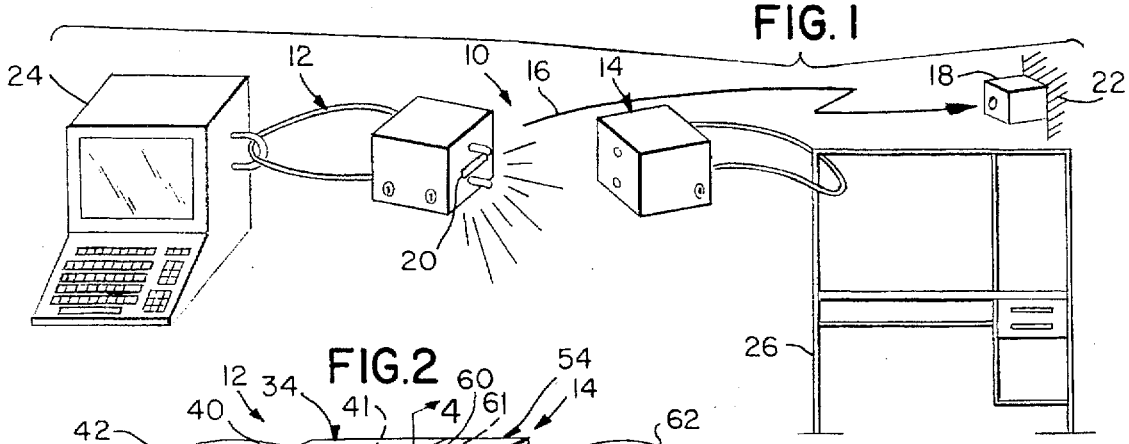
FIG. 2
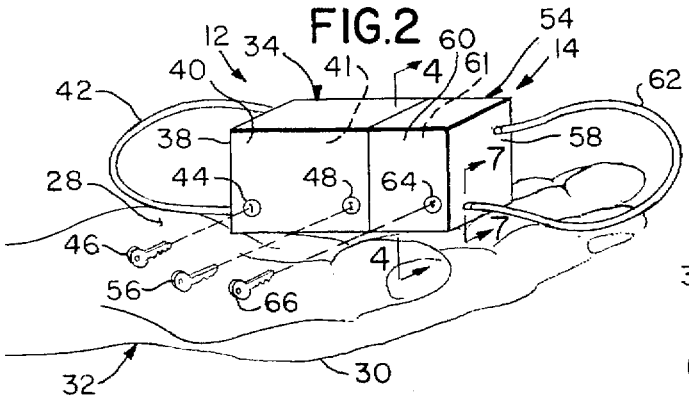
FIG. 3
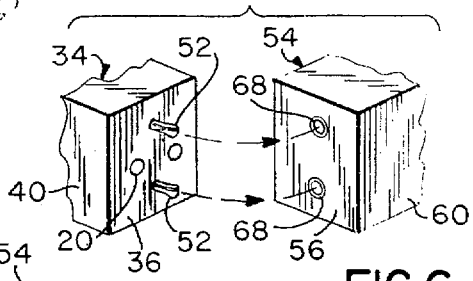
FIG. 4
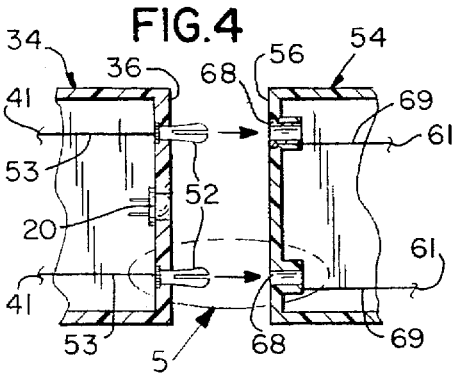
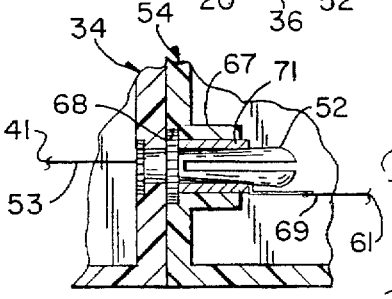
FIG. 5
FIG. 6
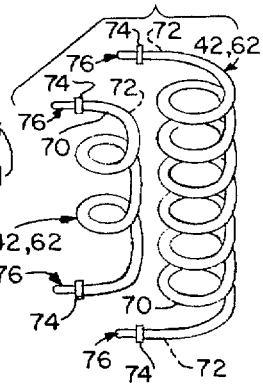
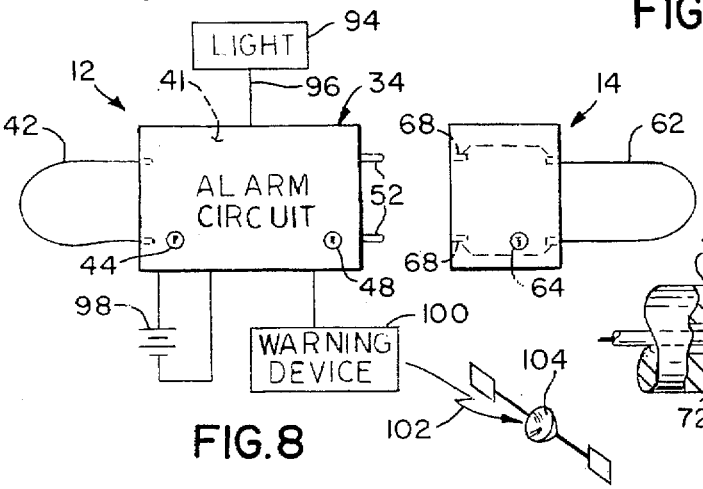
FIG. 8
FIG. 7
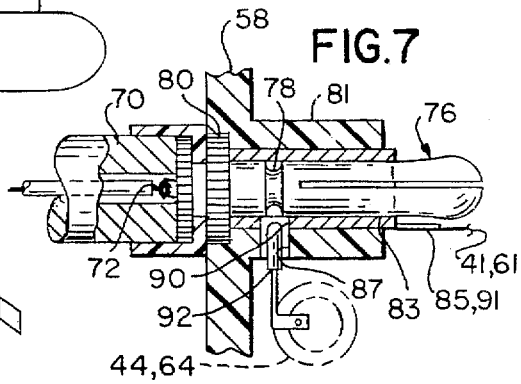

UNIVERSAL ALARM SYSTEM

BACKGROUND OF THE INVENTION

The present invention relates to a universal alarm system. More particularly, the present invention relates to a universal alarm system that includes a first small hollow parallelepiped-shaped housing that contains an internally disposed alarm circuit and has on one side thereof a pair of jacks that are in electrical communication with the internally disposed alarm circuit and on an opposing side thereof has a pair of plugs that are in electrical communication with the internally disposed alarm circuit, a first cable that has free end plugs that are replaceably engagable with the pair of jacks of the first small hollow parallelepiped-shaped housing, a second small hollow parallelepiped-shaped housing that contains an internally disposed circuit and has on one side thereof a pair of jacks that are in electrical communication with the internally disposed circuit and which are replaceably engagable with the pair of plugs of the first small hollow parallelepiped-shaped housing and on an opposing side thereof has a pair of jacks that are in electrical communication with the internally disposed alarm circuit, and a second cable that has free end plugs that are replaceably engagable with the pair of jacks of the opposing side of the second small hollow parallelepiped-shaped housing.

Alarm systems and anti-theft devices are known in the art. In general, such devices contain sensors to detect motion or a breech of integrity in the device itself or in the object being protected. The increase in sales and installation of home security systems and motor vehicle security systems is symptomatic of a society where the need for such security devices is increasing, and this need has resulted in a large number of such devices, many of which are unnecessarily expensive and complex.

A portable breakaway alarm system as taught in my U.S. Pat. No. 5,408,213 includes a pair of interlocking structural components, one of which contains a magnet and the other of which contains a simple electrical circuit that has a magnetically actuated switch. Physical separation of the components causes sounding of an alarm attached to and operable in response to removal of the switch from the vicinity of the magnet.

My U.S. Pat. No. 5,408,213 differs from the present invention in that it does not teach a universal alarm system that includes a first small hollow parallelepiped-shaped housing that contains an internally disposed alarm circuit and has on one side thereof a pair of jacks that are in electrical communication with the internally disposed alarm circuit and on an opposing side thereof has a pair of plugs that are in electrical communication the internally disposed alarm circuit, a first cable that has free end plugs that are replaceably engagable with the pair of jacks of the first small hollow parallelepiped-shaped housing, a second small hollow parallelepiped-shaped housing that contains an internally disposed circuit and has on one side thereof a pair of jacks that are in electrical communication with the internally disposed circuit and which are replaceably engagable with the pair of plugs of the first small hollow parallelepiped-shaped housing and on an opposing side thereof has a pair of jacks that are in electrical communication with the internally disposed alarm circuit, and a second cable that has free end plugs that are replaceably engagable with the pair of jacks of the opposing side of the second small hollow parallelepiped-shaped housing.

SUMMARY OF THE INVENTION

ACCORDINGLY, AN OBJECT of the present invention is to provide a universal alarm system that avoids the disadvantages of the prior art.

ANOTHER OBJECT of the present invention is to provide a universal alarm system that is simple and inexpensive to manufacture.

STILL ANOTHER OBJECT of the present invention is to provide a universal alarm system that is simple to use.

YET STILL ANOTHER OBJECT of the present invention is to provide a universal alarm system that is activated when the pair of main components are separated.

STILL YET ANOTHER OBJECT of the present invention is to provide a universal alarm system that is activated when at least one of the pair of cables is separated or cut.

YET STILL ANOTHER OBJECT of the present invention is to provide a universal alarm system that when the pair of main components are separated will actuate an alarm.

STILL YET ANOTHER OBJECT of the present invention is to provide a universal alarm system that when activated will signal a pager or other communication device.

YET ANOTHER OBJECT of the present invention is to provide a universal alarm system that when activated will actuate a video, a still-camera, or a tracking device.

STILL YET ANOTHER OBJECT of the present invention is to provide a universal alarm system that can be reset by bringing the pair of separated components together.

YET STILL ANOTHER OBJECT of the present invention is to provide a universal alarm system that can be reset by reattaching the at least one separated cable.

STILL YET ANOTHER OBJECT of the present invention is to provide a universal alarm system that can be reset by using a keyed cable lock.

YET STILL ANOTHER OBJECT of the present invention is to provide a universal alarm system whose cable lock is used to disconnect the cable.

STILL YET ANOTHER OBJECT of the present invention is to provide a universal alarm system wherein the cables are connectable to increase the length thereof.

BRIEFLY STATED, YET STILL ANOTHER OBJECT of the present invention is to provide a universal alarm system that includes a first main component and a second main component.

STILL YET ANOTHER OBJECT of the present invention is to provide a universal alarm system wherein the first main component contains an internally-disposed continuous loop alarm circuit and is attachable to a first object that is to be protected against an unauthorized removal thereof.

YET STILL ANOTHER OBJECT of the present invention is to provide a universal alarm system wherein the second main component replaceably engages the first main component, by non-magnetic magnetic means, and contains an internally-disposed circuit and is attachable to a second object.

STILL YET ANOTHER OBJECT of the present invention is to provide a universal alarm system wherein the internally-disposed continuous loop alarm circuit of the first main component is in electrical communication with the internally-disposed circuit of the second main component when the first main component is engaged with the second main component, so that when the first main component and the second main component are separated from each other the internally-disposed continuous loop alarm circuit of the first main component activates an alarm and since the first main component remains with the first object location of the first object is facilitated.

YET STILL ANOTHER OBJECT of the present invention is to provide a universal alarm system wherein the first main component includes a hollow housing that has an inner wall with a shape, an outer wall that is disposed in opposition to the inner wall of the hollow housing of the first main component, and a front wall that spans from the inner wall of the hollow housing of the first main component to the outer wall of the hollow housing of the first main component.

STILL YET ANOTHER OBJECT of the present invention is to provide a universal alarm system wherein the hollow housing of the first main component is a strong molded plastic.

YET STILL ANOTHER OBJECT of the present invention is to provide a universal alarm system wherein the first main component further includes a cable that is replaceably engagable with the hollow housing of the first main component and the first object.

STILL YET ANOTHER OBJECT of the present invention is to provide a universal alarm system wherein the cable of the first main component is in electrical communication with the internally-disposed continuous loop alarm circuit of the first main component when engaged with the hollow housing of the first main component, so that attachment and detachment of the cable of the first main component relative to the hollow housing of the first main component accomplishes at least a function selected from the group consisting of arming the alarm, disarming the alarm, resetting the alarm, and combinations thereof, and so that the alarm is activated when the cable is selected from the group consisting of cut, and separated from the hollow housing of the first main component.

YET STILL ANOTHER OBJECT of the present invention is to provide a universal alarm system wherein the cable of the first main component has a strong, flexible insulating material sheath that contains an internally-disposed conducting wire therein, and each of a pair of free ends that has disposed thereon an electrically-conductive plug that is in electrical communication with the internally-disposed conducting wire of the cable of the first main component.

STILL YET ANOTHER OBJECT of the present invention is to provide a universal alarm system wherein the electrically-conductive plug of each of the pair of free ends of the cable of the first main component has a circumferencially-disposed groove that is disposed completely around the electrically-conductive plug of each of the pair of free ends of the cable of the first main component.

YET STILL ANOTHER OBJECT of the present invention is to provide a universal alarm system wherein the first main component further includes a cable key lock release that is disposed on the hollow housing of the first main component in proximity to the cable of the first main component, so that the cable of the first main component is lockingly secured to the hollow housing of the first main component.

STILL YET ANOTHER OBJECT of the present invention is to provide a universal alarm system wherein the cable key lock release of the first main component is in electrical communication with the internally-disposed continuous loop alarm circuit of the first main component, so that the cable key lock release of the first main component accomplishes at least a function selected from the group consisting of arming the alarm, disarming the alarm, resetting the alarm, and combinations thereof.

YET STILL ANOTHER OBJECT of the present invention is to provide a universal alarm system wherein the first main component further includes a key for turning the cable key lock release of the first main component.

STILL YET ANOTHER OBJECT of the present invention is to provide a universal alarm system wherein the first main component further includes a main component key lock that is disposed on the hollow housing of the first main component, in proximity to the inner wall of the hollow housing of the first main component, so that the first main component and the second main component are lockingly secured to each other.

YET STILL ANOTHER OBJECT of the present invention is to provide a universal alarm system wherein the main component key lock of the first component is in electrical communication with the internally-disposed continuous loop alarm circuit of the first main component, so that the main component key lock of the first component accomplishes at least a function selected from the group consisting of arming the alarm, disarming the alarm, resetting the alarm, and combinations thereof.

STILL YET ANOTHER OBJECT of the present invention is to provide a universal alarm system wherein the first main component further includes a key for turning the main component key lock.

YET STILL ANOTHER OBJECT of the present invention is to provide a universal alarm system wherein the second main component includes a hollow housing having an inner wall with a shape, an outer wall that is disposed in opposition to the inner wall of the hollow housing of the second main component, and a front wall that spans from the inner wall of the hollow housing of the second main component to the outer wall of the hollow housing of the second main component.

STILL YET ANOTHER OBJECT of the present invention is to provide a universal alarm system wherein the shape of the inner wall of the hollow housing of the second main component and the shape of the inner wall of the first hollow housing of the first main component are contiguous when in contact with each other.

YET STILL ANOTHER OBJECT of the present invention is to provide a universal alarm system wherein at least one of the first main component and the second main component further includes at least one electrically-conductive plug that is embedded in a respective throughbore in the inner wall of the hollow housing of the at least one of the first main component and the second main component and extends outwardly therefrom.

STILL YET ANOTHER OBJECT of the present invention is to provide a universal alarm system wherein the at least one electrically-conductive plug of the inner wall of the hollow housing of the at least one of the first main component and the second main component is in electrical communication with at least one of the internally-disposed continuous loop alarm circuit of the first main component and the internally-disposed circuit of the second main component.

YET STILL ANOTHER OBJECT of the present invention is to provide a universal alarm system wherein the hollow housing of the second main component is a strong molded plastic.

STILL YET ANOTHER OBJECT of the present invention is to provide a universal alarm system wherein the second main component further includes a cable that is replaceably engagable with the hollow housing of the second main component and the second object.

YET STILL ANOTHER OBJECT of the present invention is to provide a universal alarm system wherein the cable of the second main component is in electrical communication with the internally-disposed circuit of the second main component when engaged with the hollow housing of the second main component, so that attaching and detaching the cable of the second main component relative to the hollow housing of the second main component accomplishes at least a function selected from the group consisting of arming the alarm, disarming the alarm, resetting the alarm, and combinations thereof, and so that the alarm is activated when the cable is selected from the group consisting of cut, and separated from the hollow housing of the second main component.

STILL YET ANOTHER OBJECT of the present invention is to provide a universal alarm system wherein the cable of the second main component has a strong, flexible insulating material sheath that contains an internally-disposed conducting wire therein, and each of a pair of free ends that has disposed thereon an electrically-conductive plug that is in electrical communication with the internally-disposed conducting wire of the cable of the second main component.

YET STILL ANOTHER OBJECT of the present invention is to provide a universal alarm system wherein the electrically-conductive plug of each of the pair of free ends of the cable of the second main component has a circumferencially-disposed groove that is disposed completely around the electrically-conductive plug of each of the pair of free ends of the cable of the second main component.

STILL YET ANOTHER OBJECT of the present invention is to provide a universal alarm system wherein the second main component further includes a cable key lock release that is disposed on the hollow housing of the second main component, in proximity to the cable of the second main component, so that the cable of the second main component is lockingly secured to the hollow housing of the second main component.

YET STILL ANOTHER OBJECT of the present invention is to provide a universal alarm system wherein the cable key lock release of the second main component is in electrical communication with the internally-disposed circuit of the second main component, so that the cable key lock release of the second main component accomplishes at least a function selected from the group consisting of arming the alarm, disarming the alarm, resetting the alarm, and combinations thereof.

STILL YET ANOTHER OBJECT of the present invention is to provide a universal alarm system wherein the second main component further includes a key for turning the cable key lock release of the second main component.

YET STILL ANOTHER OBJECT of the present invention is to provide a universal alarm system wherein the at least one of the first main component and the second main component further includes at least one first jack that is embedded in a respective throughbore with a perimeter in the inner wall of the hollow housing of the at least one of the first main component and the second main component.

STILL YET ANOTHER OBJECT of the present invention is to provide a universal alarm system wherein the at least one first jack of the inner wall of the hollow housing of the at least one of the first main component and the second main component is precisely aligned with the at least one electrically-conductive plug of the inner wall of the hollow housing of the at least one of the first main component and the second main component, so that when the at least one electrically-conductive plug of the inner wall of the hollow housing of the at least one of the first main component and the second main component engage the at least one first jack of the inner wall of the hollow housing of the at least one of the first main component and the second main component, the second main component and the first main component are held together securely, the second main component and the first main component are prevented from relative rotation, and the internally-disposed continuous loop alarm circuit of the first main component is in electrical communication with the internally-disposed circuit of the second main component, so that the attaching and detaching of the first main component and the second main component relative to each other accomplishes at least a function selected from the group consisting of arming the alarm, disarming the alarm, resetting the alarm, and combinations thereof.

YET STILL ANOTHER OBJECT of the present invention is to provide a universal alarm system wherein the at least one first jack of the inner wall of the hollow housing of the at least one of the first main component and the second main component has a non-electrically-conductive outer sleeve that extends inwardly from, and is integral with, the perimeter of the respective throughbore of the inner wall of the hollow housing of the at least one of the first main component and the second main component.

STILL YET ANOTHER OBJECT of the present invention is to provide a universal alarm system wherein the at least one first jack of the inner wall of the hollow housing of the at least one of the first main component and the second main component further has an electrically-conductive inner sleeve.

YET STILL ANOTHER OBJECT of the present invention is to provide a universal alarm system wherein the electrically-conductive inner sleeve of the at least one first jack of the inner wall of the hollow housing of the at least one of the first main component and the second main component extends inwardly from the perimeter of the respective throughbores the inner wall of the hollow housing of the at least one of the first main component and the second main component.

STILL YET ANOTHER OBJECT of the present invention is to provide a universal alarm system wherein the electrically-conductive inner sleeve of the at least one first jack of the inner wall of the hollow housing of the at least one of the first main component and the second main component is internal to the non-electrically-conductive outer sleeve of the at least one first jack of the inner wall of the hollow housing of the at least one of the first main component and the second main component.

YET STILL ANOTHER OBJECT of the present invention is to provide a universal alarm system wherein the electrically-conductive inner sleeve of the at least one first jack of the inner wall of the hollow housing of the first main component and the second main component is in electrical communication with the at least one of the internally-disposed continuous loop alarm circuit of the first main component and the internally-disposed circuit of the second main component.

STILL YET ANOTHER OBJECT of the present invention is to provide a universal alarm system wherein the first main component further includes a pair of second jacks that are embedded in a pair of throughbores with perimeters in the outer wall of the hollow housing of the first main component.

YET STILL ANOTHER OBJECT of the present invention is to provide a universal alarm system wherein each of the pair of second jacks of the outer wall of the hollow housing of the first main component has a non-electrically-conductive outer sleeve that extends inwardly from, and is integral with, a perimeter of a respective throughbore of the pair of throughbores of the outer wall of the hollow housing of the first main component.

STILL YET ANOTHER OBJECT of the present invention is to provide a universal alarm system wherein the non-electrically-conductive outer sleeve of each of the pair of second jacks of the outer wall of the first main component has a laterally-oriented throughbore.

YET STILL ANOTHER OBJECT of the present invention is to provide a universal alarm system wherein the laterally-oriented throughbore of the non-electrically-conductive outer sleeve of each of the pair of second jacks of the first main component is in alignment with the circumferencially-disposed groove of the plug of a respective free end of the pair of free ends of the cable of the first main component when the plug of the respective free end of the pair of free ends of the cable of the first main component is received by a respective one of the pair of second jacks of the first main component.

STILL YET ANOTHER OBJECT of the present invention is to provide a universal alarm system wherein each of the pair of second jacks of the first main component further has an electrically-conductive inner sleeve that extends inwardly from the perimeter of the respective throughbore of the pair of throughbores of the outer wall of the hollow housing of the first main component.

YET STILL ANOTHER OBJECT of the present invention is to provide a universal alarm system wherein the electrically-conductive inner sleeve of each of the pair of second jacks of the outer wall of the first main component is internal to the non-electrically-conductive outer sleeve of a respective jack of the pair of second jacks of the outer wall of the first main component.

STILL YET ANOTHER OBJECT of the present invention is to provide a universal alarm system wherein the electrically-conductive inner sleeve of each of the pair of second jacks of the outer wall of the first main component has a laterally-oriented throughbore that is in alignment with the laterally-oriented throughbore of the non-electrically-conductive outer sleeve of the respective jack of the pair of second jacks of the first main component.

YET STILL ANOTHER OBJECT of the present invention is to provide a universal alarm system wherein the electrically-conductive inner sleeve of each of the pair of second jacks of the outer wall of the first main component is in electrical communication with the internally-disposed continuous loop alarm circuit of the first main component.

STILL YET ANOTHER OBJECT of the present invention is to provide a universal alarm system wherein the cable key lock release of the first main component is operatively connected to a prong that passes into the laterally-oriented throughbore of the non-electrically-conductive outer sleeve of each of the pair of second jacks of the outer wall of the first main component and the electrically-conductive inner sleeve of each of the pair of jacks of the outer wall of the first main component.

YET STILL ANOTHER OBJECT of the present invention is to provide a universal alarm system wherein the plug of each of the pair of free ends of the cable of the first main component is securely engaged in the respective jack of the pair of second jacks of the first main component by turning the cable key lock release of the first main component and causing the prong of the cable key lock release of the first main component to enter the circumferencially-disposed groove of the electrically-conductive plug of each of the pair of free ends of the cable of the first main component, so that the cable of the first main component is locking secured in the pair of second jacks of the first main component and can not be undesirably removed therefrom.

STILL YET ANOTHER OBJECT of the present invention is to provide a universal alarm system wherein the second main component further includes a pair of third jacks that are embedded in a pair of throughbores with perimeters in the outer wall of the hollow housing of the second main component.

YET STILL ANOTHER OBJECT of the present invention is to provide a universal alarm system wherein each of the pair of third jacks of the outer wall of the hollow housing of the second main component has a non-electrically-conductive outer sleeve that extends inwardly from, and is integral with, a perimeter of a respective throughbore of the pair throughbores of the outer wall of the hollow housing of the second main component.

STILL YET ANOTHER OBJECT of the present invention is to provide a universal alarm system wherein the non-electrically-conductive conductive outer sleeve of each of the pair of third jacks of the outer wall of the hollow housing of the second main component has a laterally-oriented throughbore.

YET STILL ANOTHER OBJECT of the present invention is to provide a universal alarm system wherein the laterally-oriented throughbore of the non-electrically-conductive outer sleeve of each of the pair of third jacks of the outer wall of the hollow housing of the second main component is in alignment with the circumferencially-disposed groove of the plug of each of the pair of free ends of the cable of the second main component when the plug of each of the pair of free ends of the cable of the second main component is received by a respective jack of the pair of third jacks of the outer wall of the hollow housing of the second main component.

STILL YET ANOTHER OBJECT of the present invention is to provide a universal alarm system wherein each of the pair of third jacks of the outer wall of the hollow housing of the second main component further has an electrically-conductive inner sleeve that extends inwardly from the perimeter of the respective throughbore of the pair of throughbores of the outer wall of the hollow housing of the second main component.

YET STILL ANOTHER OBJECT of the present invention is to provide a universal alarm system wherein the electrically-conductive inner sleeve of each of the pair of third jacks of the outer wall of the hollow housing of the second main component is internal to the non-electrically-conductive outer sleeve of a respective jack of the pair of third jacks of the second main component.

STILL YET ANOTHER OBJECT of the present invention is to provide a universal alarm system wherein the inner sleeve of each of the pair of third jacks of the outer wall of the hollow housing of the second main component has a laterally-oriented throughbore that is in alignment with the laterally-oriented throughbore of the non-electrically-conductive outer sleeve of the respective jack of the pair of third jacks of the outer wall of the hollow housing of the second main component.

YET STILL ANOTHER OBJECT of the present invention is to provide a universal alarm system wherein the electrically-conductive inner sleeve of each of the pair of third jacks of the outer wall of the hollow housing of the second main component is in electrical communication with the internally-disposed circuit of the second main component.

STILL YET ANOTHER OBJECT of the present invention is to provide a universal alarm system wherein the cable key lock release of the second main component is operatively connected to a prong that passes into the laterally-oriented throughbore of the non-electrically-conductive outer sleeve of each of the pair of third jacks of the outer wall of the hollow housing of the second main component and the electrically-conductive inner sleeve of the respective jack of the pair of third jacks of the second main component.

YET STILL ANOTHER OBJECT of the present invention is to provide a universal alarm system wherein the plug of each of the pair of free ends of the cable of the second main component is securely engaged in the pair of third jacks of the second main component by turning the cable key lock release of the second main component and causing the prong of the cable key lock release of the second main component to enter the circumferencially-disposed groove of the electrically-conductive plug of each of the pair of free ends of the cable of the second main component, so that the cable of the second main component is locking secured in the pair of third jacks of the second main component and can not be undesirably removed therefrom.

STILL YET ANOTHER OBJECT of the present invention is to provide a universal alarm system that further includes an indicator light that is in electrical communication with the internally-disposed continuous loop alarm circuit of the first main component and indicates when the alarm is armed and in condition to be actuated.

YET STILL ANOTHER OBJECT of the present invention is to provide a universal alarm system that further includes a light that is disposed on the inner wall of the hollow housing of the first main component and is in electrical communication with the internally-disposed continuous loop alarm circuit of the first main component, so that when the first main component and the second main component are separated from each other the light can be detected by a remote camera which can record the unauthorized removal of the first object.

STILL YET ANOTHER OBJECT of the present invention is to provide a universal alarm system that further includes a warning device that is in electrical communication with the internally-disposed continuous loop alarm circuit of the first main component and warns that the unauthorized removal of the first object is occurring.

FINALLY, YET STILL ANOTHER OBJECT of the present invention is to provide a universal alarm system wherein the warning device of the first main component generates at least a signal selected from the group consisting of audible, pager, video camera, still-camera, communication, and satellite.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view illustrating the present invention being utilized to lock a computer to a bookcase;

FIG. 2 is a diagrammatic perspective view of the present invention illustrating it's small size;

FIG. 3 is an enlarged diagrammatic perspective view illustrating the cooperation between the pair of main components of the present invention;

FIG. 4 is an enlarged cross sectional view taken on line 4—4 in FIG. 2, with parts broken away, and illustrating the means for attaching the pair of main components of the present invention to each other;

FIG. 5 is an enlarged cross sectional view of the area. enclosed by the broken ellipse identified by arrow 5 in FIG. 5, with parts broken away;

FIG. 6 is a diagrammatic perspective view illustrating a typical set of different length locking cables;

FIG. 7 is an enlarged cross sectional view taken on line 7—7 in FIG. 2, with parts broken away, and illustrating the means for locking the locking cables to the pair of main components of the present invention; and FIG. 8 is diagrammatic schematic block diagram of the present invention.

DETAILED DESCRIPTION OF THE PREFERRED EMBODIMENT

Referring now to the figures in which like numerals indicate like parts, and particularly to FIG. 1, the universal alarm system of the present invention is shown generally at 10. The universal alarm system 10 includes a first main component 12 and a second main component 14 that is replaceably engagable with the first main component 12 by non-magnetic means.

When the first main component 12 is separated from the second main component 14, a separation signal 16 is generated by a signal generator 20 of the first main component 12, which is detected by a remote detector 18.

The separation signal 16, generated by the signal generator 20, can be specifically coded and can be in the form of a light, but is not limited to that. When the first main component 12 is separated from the second main component 14, the remote detector 18, which can be disposed at a distance on a wall 22, is free to receive the separation signal 16 generated by the signal generator 20.

The remote detector 18 can be a pager (not shown) or other communication device (not shown), and/or a video camera (not shown), and/or a still-camera (not shown), and/or a tracking device (not shown), but is not limited to that, and which would be activated by the separation signal 16 generated by the signal generator 20.

The first main component 12 is secured to a computer 24 and may either be fixedly mounted thereto or replaceably attached thereto, depending on the desire of the user. The second main component 14 is secured to a bookcase 26.

The replaceable engagability of the first main component 12 with the second main component 14, allows the computer 24 to be moved to another universal alarm system 10, if so desired. If however, the computer 24 is stolen, since the first main component 12 is secured to the computer 24, the first main component 12 will remain with the stolen computer 24 better enabling the computer 24 to be recovered.

Further, if the first main component 12 is replaceably mounted to the computer 24, the computer 24 can be removed from the universal alarm system 10.

It is to be understood, however, that the use of the computer 24 and the bookcase 26 are for illustrative purposes only, and that the universal alarm system 10 can be used to secure any object to any other object whose configurations so oblige without departing in any way from the spirit of the present invention.

The overall configuration of the universal alarm system 10 can best be seen in FIGS. 2 and 3, and as such, will be discussed with reference thereto.

The universal alarm system 10 is small enough to fit in a user hand palm 28 of a user hand 30 of a user 32, and has a thin and visibly attractive appearance.

The first main component 12 includes a first main component hollow housing 34 having a first main component housing inner wall 36, a first main component housing outer wall 38 that is disposed in opposition to the first main component housing inner wall 36 of the first main component hollow housing 34 of the first main component 12, and a first main component housing front wall 40 that spans from the first main component housing inner wall 36 of the first main component hollow housing 34 of the first main component 12 to the first main component housing outer wall 38 of the first main component hollow housing 34 of the first main component 12.

The first main component hollow housing 34 of the first main component 12 is preferably composed of a strong molded plastic, but is not limited to that, and can be of any desired shape.

The first main component 12 further includes an internally-disposed continuous loop alarm circuit 41 that is contained in the first main component hollow housing 34 of the first main component 12. The internally-disposed continuous loop alarm circuit 41 of the first main component 12 is of the continuous loop type, that is well known in the art.

The first main component 12 further includes a first main component locking cable 42 that is replaceably engagable, on a diagonal, with the first main component housing outer wall 38 of the first main component hollow housing 34 of the first main component 12 and can be used to replaceably attach the computer 24 to the first main component 12 by passing through an appropriate loop or the like disposed on the computer 24.

The first main component locking cable 42 of the first main component 12 is in electrical communication with the internally-disposed continuous loop alarm circuit 41 of the first main component 12, when engaged with the first main component housing outer wall 38 of the first main component hollow housing 34 of the first main component 12.

The attachment and detachment of the first main component locking cable 42 of the first main component 12 can act as a device to arm and/or disarm and/or reset the universal alarm system 10.

The first main component 12 further includes a first main component locking cable key lock release 44 that is disposed on the first main component housing front wall 40 of the first main component hollow housing 34 of the first main component 12, in proximity to the first main component housing outer wall 38 of the first main component hollow housing 34 of the first main component 12.

The first main component locking cable key lock release 44 of the first main component 12 is in electrical communication with the internally-disposed continuous loop alarm circuit 41 of the first main component 12, and can act as a device to arm and/or disarm and/or reset the universal alarm system 10.

The first main component locking cable key lock release 44 of the first main component 12 is turned by a first main component locking cable key lock release key 46.

The first main component 12 further includes a first main component engaging key lock 48 that is disposed on the first main component housing front wall 40 of the first main component hollow housing 34 of the first main component 12, in proximity to the first main component housing inner wall 36 of the first main component hollow housing 34 of the first main component 12 and is used to lock the first main component 12 to the second main component 14.

The first main component engaging key lock 48 is in electrical communication with the internally-disposed continuous loop alarm circuit 41 of the first main component 12, and can act as a device to arm and/or disarm and/or reset the universal alarm system 10.

The first main component engaging key lock 48 of the first main component 12 is turned by a first main component engaging key lock key 50.

The first main component 12 further includes a pair of first main component housing inner wall horizontally-disposed, vertically-spaced, and electrically-conductive bifurcated plugs 52 that are embedded in the first main component housing inner wall 36 of the first main component hollow housing 34 of the first main component 12, and extend outwardly therefrom.

The pair of first main component housing inner wall horizontally-disposed, vertically-spaced, and electrically-conductive bifurcated plugs 52 of the first main component 12 are in electrical communication with the internally-disposed continuous loop alarm circuit 41 of the first main component 12, via first main component housing inner wall plug electrical conductors 53.

The first main component 12 further includes the signal generator 20 that is disposed on the first main component housing inner wall 36 of the first main component hollow housing 34 of the first main component 12, intermediate the pair of first main component housing inner wall horizontally-disposed, vertically-spaced, and electrically-conductive bifurcated plugs 52 of the first main component 12.

The second main component 14, includes a second main component hollow housing 54 having a second main component housing inner wall 56, a second main component housing outer wall 58 that is disposed in opposition to the second main component housing inner wall 56 of the second main component hollow housing 54 of the second main component 14, and a second main component housing front wall 60 that spans from the second main component housing inner wall 56 of the second main component hollow housing 54 of the second main component 14 to the second main component housing outer wall 58 of the second main component hollow housing 54 of the second main component 14.

The second main component hollow housing 54 of the second main component 14 is preferably composed of a strong molded plastic, but is not limited to that, and can be of any desired shape.

The shape of the second main component housing inner wall 56 of the second main component hollow housing 54 of the second main component 14 and the shape of the first main component housing inner wall 36 of the first main component hollow housing 34 of the first main component 12, however, must be flat and coplanar or otherwise so shaped so as to be contiguous when they meet, so that the signal generator 20 is concealed and does not inadvertently generate the separation signal 16.

The second main component hollow housing 54 of the second main component 14 further includes an internally-disposed circuit 61 that is contained in the second main component hollow housing 54 of the second main component 14.

The second main component 14 further includes a second main component locking cable 62 that is replaceably engagable, on a diagonal, with the second main component housing outer wall 58 of the second main component hollow housing 54 of the second main component 14.

The second main component locking cable 62 is in electrical communication with the internally-disposed circuit 61 of the second main component 14, when engaged with the second main component housing outer wall 58 of the second main component hollow housing 54 of the second main component 14.

The attachment and detachment of the second main component locking cable 62 of the second main component 14 can act as a device to arm and/or disarm and/or reset the universal alarm system 10.

The second main component 14 further includes a second main component locking cable key lock release 64 that is disposed on the second main component housing front wall 60 of the second main component hollow housing 54 of the second main component 14, in proximity to the second main component housing outer wall 58 of the second main component hollow housing 54 of the second main component 14.

The second main component locking cable key lock release 64 of the second main component 14 is in electrical communication with the internally-disposed circuit 61 of the second main component 14, and can act as a device to arm and/or disarm and/or reset the universal alarm system 10.

The second main component locking cable key lock release 64 of the second main component 14 is turned by a second main component locking cable key lock release key 66.

The second main component 14 further includes a pair of second main component housing inner wall vertically-spaced-apart jacks 68 that are embedded in a pair of second main component housing inner wall throughbores in the second main component housing inner wall 56 of the second main component hollow housing 54 of the second main component 14.

Each of the pair of second main component housing inner wall vertically-spaced-apart jacks 68 of the second main component 14 has a second main component housing inner wall jack cylindrically-shaped and non-electrically-conductive outer sleeve 67 that extends inwardly from, and is integral with, the perimeter of the each of the pair of second main component housing inner wall throughbores of the second main component housing inner wall 56 of the second main component hollow housing 54 of the second main component 14.

Each of the pair of second main component housing inner wall vertically-spaced-apart jacks 68 of the second main component 14 further has a second main component housing inner wall jack cylindrically-shaped and electrically-conductive inner sleeve 71.

The second main component housing inner wall jack cylindrically-shaped and electrically-conductive inner sleeve 71 of each of the pair of second main component housing inner wall vertically-spaced-apart jacks 68 of the second main component 14 extends inwardly from the perimeter of the each of the pair of second main component housing inner wall throughbores of the second main component housing inner wall 56 of the second main component hollow housing 54 of the second main component 14.

The second main component housing inner wall jack cylindrically-shaped and electrically-conductive inner sleeve 71 of each of the pair of second main component housing inner wall vertically-spaced-apart jacks 68 of the second main component 14 is internal to, and concentric with, the second main component housing inner wall jack cylindrically-shaped and non-electrically-conductive outer sleeve 67 of each of the pair of second main component housing inner wall vertically-spaced-apart jacks 68 of the second main component 14.

The second main component housing inner wall jack cylindrically-shaped and electrically-conductive inner sleeve 71 of each of the pair of second main component vertically-spaced-apart jacks 68 of the second main component 14 are in electrical communication with the internally-disposed circuit 61 of the second main component 14, via second main component housing inner wall jack electrical conductors 69.

The means for engaging the first main component 12 with the second main component 14 can best be seen in FIGS. 4 and 5, and as such, will be discussed with reference thereto.

The pair of first main component housing inner wall horizontally-disposed, vertically-spaced, and electrically-conductive bifurcated plugs 52 of the first main component 12 are precisely aligned with the pair of second main component housing inner wall vertically-spaced-apart jacks 68 of the second main component 14.

When the first main component 12 and the second main component 14 are physically moved toward each other, the pair of first main component housing inner wall horizontally-disposed, vertically-spaced, and electrically-conductive bifurcated plugs 52 of the first main component 12 compress and enter the pair of second main component housing inner wall vertically-spaced-apart jacks 68 of the second main component 14.

When the first main component housing inner wall 36 of the first main component hollow housing 34 of the first main component 12 and the second main component housing inner wall 56 of the second main component hollow housing 54 of the second main component 14 contact each other, the pair of first main component housing inner wall horizontally-disposed, vertically-spaced, and electrically-conductive bifurcated plugs 52 of the first main component 12 expand in the pair of second main component housing inner wall vertically-spaced-apart jacks 68 of the second main component 14, so that the second main component 14 and the first main component 12 are held together securely, are prevented from relative rotation, substantial effort is needed to separate the second main component 14 from the first main component 12, and the internally-disposed continuous loop alarm circuit 41 of the first main component 12 is in electrical communication with the internally-disposed circuit 61 of the second main component 14.

It is to be understood that the pair of first main component housing inner wall horizontally-disposed, vertically-spaced, and electrically-conductive bifurcated plugs 52 are preferably disposed on the first main component housing inner wall 36 of the first main component hollow housing 34 of the first main component 12 and that the pair of second main component housing inner wall vertically-spaced-apart jacks 68 are preferably disposed on the second main component housing inner wall 56 of the second main component hollow housing 54 of the second main component 14, however, one or both of the pair of first main component housing inner wall horizontally-disposed, vertically-spaced, and electrically-conductive bifurcated plugs 52 can be disposed on either the first main component housing inner wall 36 of the first main component hollow housing 34 of the first main component 12 or on the second main component housing inner wall 56 of the second main component hollow housing 54 of the second main component 14 and that one or both of the pair of second main component housing inner wall vertically-spaced-apart jacks 68 can be disposed on either the first main component housing inner wall 36 of the first main component hollow housing 34 of the first main component 12 or on the second main component housing inner wall 56 of the second main component hollow housing 54 of the second main component 14, so that any combinations thereof can be used to secure the first main component 12 and the second main component 14 to each other without departing in any way from the spirit of the present invention.

The attachment and detachment of the first main component 12 with the second main component 14 can act as a device to arm and/or disarm and/or reset the universal alarm system 10.

The second main component 14 and the first main component 12 can only be separated by a forced movement of one or both of the second main component 14 and the first main component 12. The second main component 14 and the first main component 12 must therefore be pulled apart and cannot be inadvertently separated.

The configuration of the first main component locking cable 42 of the first main component 12 and the second main component locking cable 62 of the second main component 14 can best be seen in FIG. 6, and as such, will be discussed with reference thereto.

Each of the first main component locking cable 42 of the first main component 12 and the second main component locking cable 62 of the second main component 14 has a strong, flexible insulating material locking cable sheath 70 that contains an internally-disposed locking cable conducting wire 72 therein, and a pair of locking cable free ends 74.

Disposed on each of the pair of locking cable free ends 74 of the first main component locking cable 42 of the first main component 12 and the second main component locking cable 62 of the second main component 14 is a locking cable electrically-conductive and bifurcated free end plug 76 that is in electrical communication with the internally-disposed locking cable conducting wire 72 of each of the first main component locking cable 42 of the first main component 12 and the second main component locking cable 62 of the second main component 14.

The length of the first main component locking cable 42 of the first main component 12 and the length second main component locking cable 62 of the second main component 14 are variable depending upon the need.

If necessary, additional first main component locking cables 42 of the first main component 12 can be joined together by a connector (not shown) to increase the length. If necessary, additional second main component locking cables 62 of the second main component 14 can be joined together by the connector (not shown) to increase the length.

The means of engaging the first main component locking cable 42 of the first main component 12 with the first main component hollow housing 34 of the first main component 12 and the means of engaging the second main component locking cable 62 of the second main component 14 with the second main component hollow housing 54 of the second main component 14, can best be seen in FIG. 7, and as such, will be discussed with reference thereto.

The locking cable electrically-conductive and bifurcated free end plug 76 of each of the pair of locking cable free ends 74 of each of the first main component locking cable 42 of the first main component 12 and the second main component locking cable 62 of the second main component 14 have a locking cable free end plug circumferencially-disposed groove 78 that is disposed completely around the locking cable electrically-conductive and bifurcated free end plug 76 of each of the pair of locking cable free ends 74 of each of the first main component locking cable 42 of the first main component 12 and the second main component locking cable 62 of the second main component 14, in proximity to the internally-disposed locking cable conducting wire 72 of each of the first main component locking cable 42 of the first main component 12 and the second main component locking cable 62 of the second main component 14.

Each of the first main component 12 and the second main component further includes a pair of main component housing outer wall diagonally-oriented and spaced-apart jacks 80 that are embedded in a pair of main component housing outer wall throughbores in each of the first main component housing outer wall 38 of the first main component hollow housing 34 of the first main component 12 and the second main component housing outer wall 58 of the second main component hollow housing 54 of the second main component 14.

Each of the pair of main component housing outer wall diagonally-oriented and spaced-apart jacks 80 of each of the first main component 12 and the second main component 14 has a main component housing outer wall jack cylindrically-shaped and non-electrically-conductive outer sleeve 81 that extends inwardly from, and is integral with, the perimeter of the pair of main component housing outer wall throughbores of each of the first main component housing outer wall 38 of the first main component hollow housing 34 of the first main component 12 and the second main component housing outer wall 58 of the second main component hollow housing 54 of the second main component 14.

The main component housing outer wall jack cylindrically-shaped and non-electrically-conductive outer sleeve 81 of each of the pair of main component housing outer wall diagonally-oriented and spaced-apart jacks 80 of each of the first main component 12 and the second main component 14 have a main component housing outer wall jack outer sleeve laterally-oriented throughbore 87 disposed in proximity to each of the first main component housing outer wall 38 of the first main component hollow housing 34 of the first main component 12 and the second main component hollow housing 54 of the second main component 14.

The main component housing outer wall jack outer sleeve laterally-oriented throughbore 87 of the main component housing outer wall jack cylindrically-shaped and non-electrically-conductive outer sleeve 81 of each of the pair of first main component housing outer wall diagonally-oriented and spaced-apart jacks 80 of each of the first main component 12 and the second main component 14 are in alignment with the locking cable free end plug circumferencially-disposed groove 78 of the locking cable electrically-conductive and bifurcated free end plug 76 of each of the pair of locking cable free ends 74 of each of the first main component locking cable 42 of the first main component 12 and the second main component locking cable 62 of the second main component 14, when the locking cable electrically-conductive and bifurcated free end plug 76 of each of the pair of locking cable free ends 74 of each of the first main component locking cable 42 of the first main component 12 and the second main component locking cable 62 of the second main component 14 is received by each of the pair of first main component housing outer wall diagonally-oriented and spaced-apart jacks 80 of each of the first main component 12 and the second main component 14.

Each of the pair of main component housing outer wall diagonally-oriented and spaced-apart jacks 80 of each of the first main component 12 and the second main component 14 further has a main component housing outer wall jack cylindrically-shaped and electrically-conductive inner sleeve 83 that extends inwardly from the perimeter of each of the pair of main component housing outer wall throughbores of each of the first main component housing outer wall 38 of the first main component hollow housing 34 of the first main component 12 and the second main component housing outer wall 58 of the second main component hollow housing 54 of the second main component 14.

The main component housing outer wall jack cylindrically-shaped and electrically-conductive inner sleeve 83 of each of the pair of main component housing outer wall diagonally-oriented and spaced-apart jacks 80 of each of the first main component 12 and the second main component 14 are concentric with, and internal to, the main component housing outer wall jack cylindrically-shaped and non-electrically-conductive outer sleeve 81 of each of the pair of first main component housing outer wall diagonally-oriented and spaced-apart jacks 80 of each of the first main component 12 and the second main component 14.

The main component housing outer wall jack cylindrically-shaped and electrically-conductive inner sleeve 83 of each of the pair of main component housing outer wall diagonally-oriented and spaced-apart jacks 80 of each of the first main component 12 and the second main component 14 have a main component housing outer wall jack inner sleeve laterally-oriented throughbore 90 that is in alignment with the main component housing outer wall jack outer sleeve laterally-oriented throughbore 87 of the main component housing outer wall jack cylindrically-shaped and non-electrically-conductive outer sleeve 81 of each of the pair of first main component housing outer wall diagonally-oriented and spaced-apart jacks 80 of each of the first main component 12 and the second main component 14.

The main component housing outer wall jack cylindrically-shaped and electrically-conductive inner sleeve 83 of each of the pair of main component housing outer wall diagonally-oriented and spaced-apart jacks 80 of the first main component 12 are in electrical communication with the internally-disposed continuous loop alarm circuit 41 of the first main component 12, via first main component housing outer wall jack electrical conductors 85.

The main component housing outer wall jack cylindrically-shaped and electrically-conductive inner sleeve 83 of each of the pair of main component housing outer wall diagonally-oriented and spaced-apart jacks 80 of the second main component 14 are in electrical communication with the internally-disposed circuit 61 of the second main component 14, via second main component housing outer wall jack electrical conductors 91.

Each of the first main component locking cable key lock release 44 of the first main component 12 and the second main component locking cable key lock release 64 of the second main component 14 are operatively connected to a main component locking cable key lock release prong 92 that passes into the main component housing outer wall jack outer sleeve laterally-oriented throughbore 87 of the main component housing outer wall jack cylindrically-shaped and non-electrically-conductive outer sleeve 81 of each of the pair of first main component housing outer wall diagonally-oriented and spaced-apart jacks 80 of each of the first main component 12 and the second main component 14, respectively.

The locking cable electrically-conductive and bifurcated free end plug 76 of each of the pair of locking cable free ends 74 of each of the first main component locking cable 42 of the first main component 12 and the second main component locking cable 62 of the second main component 14 are securely engaged in the pair of main component housing outer wall diagonally-oriented and spaced-apart jacks 80 of the first main component 12 and the second main component 14, respectively, by turning the first main component locking cable key lock release 44 of the first main component 12 with the first main component locking cable key lock release key 46 and by turning the second main component locking cable key lock release 64 of the second main component 14 with the second main component locking cable key lock release key 66, respectively, so that the locking cable electrically-conductive and bifurcated free end plug 76 of each of the pair of locking cable free ends 74 of each of the first main component locking cable 42 of the first main component 12 and the second main component locking cable 62 of the second main component 14 are in electrical communication with the main component housing outer wall jack cylindrically-shaped and electrically-conductive inner sleeve 83 of each of the pair of main component housing outer wall diagonally-oriented and spaced-apart jacks 80 of each of the first main component 12 and the second main component 14.

As a result, the main component locking cable key lock release prong 92 of each of the first cable component locking cable key lock release 44 of the first main component 12 and the second main component locking cable key lock release 64 of the second main component 14, respectively, enter the locking cable free end plug circumferencially-disposed groove 78 of the locking cable electrically-conductive and bifurcated free end plug 76 of the pair of locking cable free ends 74 of each of the first main component locking cable 42 of the first main component 12 and the second main component locking cable 62 of the second main component 14, so that the first main component locking cable 42 of the first main component 12 and the second main component locking cable 62 of the second main component 14 are locking secured in the pair of main component housing outer wall diagonally-oriented and spaced-apart jacks 80 of each of the first main component 12 and the second main component 14, respectively, and can not be undesirably removed therefrom.

The general operation of the universal alarm system 10 can best be seen in FIG. 8, and as such, will be discussed with reference thereto.

A light 94 that may be actuated to indicate when the universal alarm system 10 is armed and in condition to be actuated, is in electrical communication with the internally-disposed continuous loop alarm circuit 41 of the first main component 12, via the first main component light electrical conductor 96.

The electrical components of the universal alarm system 10 are powered by a power source 98. The power source 98 is preferably a battery, either replaceable or rechargeable. Since the universal alarm system 10 may be constructed inexpensively, it is possible that the entire assembly including the power source 98 can be discardable.

A warning device 100 is in electrical communication with the internally-disposed continuous loop alarm circuit 41 of the first main component 12 and may be any known type of device which provides a warning such as a siren, a voice recording, a high pitched or wavering whistle, or the like, sufficient in time and intensity to attract attention to the fact that the first main component 12 and the second main component 14 may have been separated, and attempted thief may be occurring.

The warning device 100 can also generate a warning device signal 102 that can be received by a satellite 104 and processed accordingly, such as, but not limited to, relayed to a law enforcement agency or the like.

While not shown in the drawings, it is within the scope of the present invention to incorporate apertures or other sound enhancing or directional components within or associated with the universal alarm system 10 in order to assure that the alarm initiated by the warning device 100 is heard. The apertures can be placed about the periphery of the first main component 12 or otherwise located, so that the alarm cannot conveniently be muffled.

The universal alarm system 10 can be armed and/or disarmed and/or reset in a number of ways. The following are examples of such ways that are independent of each other, however, other adaptations would be apparent to one skilled in the art without departing in any way from the spirit of the present invention.

The universal alarm system 10 can be both armed and disarmed by separation of the first main component 12 from the second main component 14 alone and with the turning of the first main component locking cable key lock release 44 of the first main component 12 and/or with the turning of the second main component locking cable key lock release 64 of the second main component 14 acting as an alarm reset mechanism, so that when the alarm is activated by separation of the first main component 12 from the second main component 14 the only way to turn the alarm off is with the use of the first main component locking cable key lock release 44 of the first main component 12 and/or the second main component locking cable key lock release 64 of the second main component 14.

The universal alarm system 10 can be both armed and disarmed by the first main component locking cable key lock release 44 of the first main component 12 and/or the second main component locking cable key lock release 64 of the second main component 14 alone.

The universal alarm system 10 can be both armed and disarmed by the attaching and detaching of the first main component locking cable 42 of the first main component 12 and/or the second main component locking cable 62 of the second main component 14.

The universal alarm system 10 can be both armed and disarmed by the attaching and detaching of the first main component locking cable 42 of the first main component 12 and/or the second main component locking cable 62 of the second main component 14 alone and with the addition of the first main component locking cable key lock release 44 of the first main component 12 and/or the second main component locking cable key lock release 64 of the second main component 14 acting as an alarm reset mechanism, so that when the alarm is activated by detaching or cutting the first main component locking cable 42 of the first main component 12 and/or the second main component locking cable 62 of the second main component 14, the only way to turn the alarm off is by the use of first main component locking cable key lock release 44 of the first main component 12 and/or the second main component locking cable key lock release 64 of the second main component 14.

The above independent ways can also be prefaced by the need for the first main component locking cable 42 of the first main component 12 and the second main component locking cable 62 of the second main component 14 to be attached before any arming can be accomplished.

The universal alarm system 10 will activate when the first main component 12 is separated from the second main component 14, when any locking cable electrically-conductive and bifurcated free end plug 76 of the first main component locking cable 42 of the first main component 12 or the second main component locking cable 62 of the second main component 14 is removed, or when either of the first main component locking cable 42 of the first main component 12 or the second main component locking cable 62 of the second main component is cut.

It will be understood that each of the elements described above, or two or more together, may also find a useful application in other types of constructions differing from the types described above.

While the invention has been illustrated and described as embodied in a universal alarm system, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A universal alarm system, comprising:

a) a first main component containing an internally-disposed continuous loop alarm circuit and being attachable to a first object that is to be protected against an unauthorized removal thereof; said first main component including a hollow housing having an inner wall with a shape, an outer wall disposed in opposition to said inner wall of said hollow housing of said first main component, and a front wall spanning from said inner wall of said hollow housing of said first main component to said outer wall of said hollow housing of said first main component; said first main component further including a main component key lock disposed on said hollow housing of said first main component, in proximity to said inner wall of said hollow housing of said first main component; said main component key lock of said first component being in electrical communication with said internally-disposed continuous loop alarm circuit of said first main component; and b) a second main component replaceably engaging said first main component, by non-magnetic means, and containing an internally-disposed circuit and being attachable to a second object; said internally-disposed continuous loop alarm circuit of said first main component being in electrical communication with said internally-disposed circuit of said second main component when said first main component is engaged with said second main component, so that when said first main component and said second main component are separated from each other said internally-disposed continuous loop alarm circuit of said first main component activates an alarm and since said first main component remains with the first object, location of the first object is facilitated.

2. The system as defined in claim 1 wherein said hollow housing of said first main component is constructed of a strong molded plastic.

3. The system as defined in claim 1, wherein said first main component further includes a cable that is replaceably engagable with said hollow housing of said first main component and the first object; said cable of said first main component is in electrical communication with said internally-disposed continuous loop alarm circuit of said first main component when engaged with said hollow housing of said first main component.

4. The system as defined in claim 3, wherein said cable of said first main component has a strong, flexible insulating material sheath that contains an internally-disposed conducting wire therein, and each of a pair of free ends that has disposed thereon an electrically-conductive plug that is in electrical communication with said internally-disposed conducting wire of said cable of said first main component; said electrically-conductive plug of each of said pair of free ends of said cable of said first main component has a circumferencially-disposed groove that is disposed completely around said electrically-conductive plug of each of said pair of free ends of said cable of said first main component.

5. The system as defined in claim 4, wherein said first main component further includes a cable key lock release that is disposed on said hollow housing of said first main component in proximity to said cable of said first main component; said cable key lock release of said first main component is in electrical communication with said internally-disposed continuous loop alarm circuit of said first main component.

6. The system as defined in claim 5, wherein said first main component further includes a key for turning said cable key lock release of said first main component.

7. The system as defined in claim 4, wherein said first main component further includes a pair of jacks that are embedded in a pair of throughbores with perimeters in said outer wall of said hollow housing of said first main component; each of said pair of jacks of said outer wall of said hollow housing of said first main component has a non-electrically-conductive outer sleeve that extends inwardly from, and is integral with, a perimeter of a respective throughbore of said pair of throughbores of said outer wall of said hollow housing of said first main component; said non-electrically-conductive outer sleeve of each of said pair of jacks of said outer wall of said first main component has a laterally-oriented throughbore; said laterally-oriented throughbore of said non-electrically-conductive outer sleeve of each of said pair of jacks of said first main component is in alignment with said circumferencially-disposed groove of said plug of a respective free end of said pair of free ends of said cable of said first main component when said plug of said respective free end of said pair of free ends of said cable of said first main component is received by a respective one of said pair of jacks of said first main component.

8. The system as defined in claim 7, wherein each of said pair of jacks of said first main component further has an electrically-conductive inner sleeve that extends inwardly from said perimeter of said respective throughbore of said pair of throughbores of said outer wall of said hollow housing of said first main component; said electrically-conductive inner sleeve of each of said pair of jacks of said outer wall of said first main component is internal to said non-electrically-conductive outer sleeve of a respective jack of said pair of jacks of said outer wall of said first main component; said electrically-conductive inner sleeve of each of said pair of jacks of said outer wall of said first main component has a laterally-oriented throughbore that is in alignment with said laterally-oriented throughbore of said non-electrically-conductive outer sleeve of said respective jack of said pair of jacks of said first main component; said electrically-conductive inner sleeve of each of said pair of jacks of said outer wall of said first main component is in electrical communication with said internally-disposed continuous loop alarm circuit of said first main component.

9. The system as defined in claim 8, wherein said cable key lock release of said first main component is operatively connected to a prong that passes into said laterally-oriented throughbore of said non-electrically-conductive outer sleeve of each of said pair of jacks of said outer wall of said first main component and said electrically-conductive inner sleeve of each of said pair of jacks of said outer wall of said first main component; said plug of each of said pair of free ends of said cable of said first main component is securely engaged in said respective jack of said pair of jacks of said first main component by turning said cable key lock release of said first main component and causing said prong of said cable key lock release of said first main component to enter said circumferencially-disposed groove of said electrically-conductive plug of each of said pair of free ends of said cable of said first main component.

10. The system as defined in claim 1, wherein said first main component further includes a key for turning said main component key lock.

11. The system as defined in claim 1, wherein said second main component includes a hollow housing having an inner wall with a shape, an outer wall that is disposed in opposition to said inner wall of said hollow housing of said second main component, and a front wall that spans from said inner wall of said hollow housing of said second main component to said outer wall of said hollow housing of said second main component; said shape of said inner wall of said hollow housing of said second main component and said shape of said inner wall of said first hollow housing of said first main component are contiguous when in contact with each other.

12. The system as defined in claim 11, wherein at least one of said first main component and said second main component further includes at least one electrically-conductive plug that is embedded in a respective throughbore in said inner wall of said hollow housing of said at least one of said first main component and said second main component and extends outwardly therefrom; said at least one electrically-conductive plug of said inner wall of said hollow housing of said at least one of said first main component and said second main component is in electrical communication with at least one of said internally-disposed continuous loop alarm circuit of said first main component and said internally-disposed circuit of said second main component.

13. The system as defined in claim 12, wherein said at least one of said first main component and said second main component further includes at least one first jack that is embedded in a respective throughbore with a perimeter in said inner wall of said hollow housing of said at least one of said first main component and said second main component; said at least one first jack of said inner wall of said hollow housing of said at least one of said first main component and said second main component is precisely aligned with said at least one electrically-conductive plug of said inner wall of said hollow housing of said at least one of said first main component and said second main component.

14. The system as defined in claim 13, wherein said at least one first jack of said inner wall of said hollow housing of said at least one of said first main component and said second main component has a non-electrically-conductive outer sleeve that extends inwardly from, and is integral with, said perimeter of said respective throughbore of said inner wall of said hollow housing of said at least one of said first main component and said second main component.

15. The system as defined in claim 14, wherein said at least one first jack of said inner wall of said hollow housing of said at least one of said first main component and said second main component further has an electrically-conductive inner sleeve; said electrically-conductive inner sleeve of said at least one first jack of said inner wall of said hollow housing of said at least one of said first main component and said second main component extends inwardly from said perimeter of said respective throughbores said inner wall of said hollow housing of said at least one of said first main component and said second main component; said electrically-conductive inner sleeve of said at least one first jack of said inner wall of said hollow housing of said at least one of said first main component and said second main component is internal to said non-electrically-conductive outer sleeve of said at least one first jack of said inner wall of said hollow housing of said at least one of said first main component and said second main component; said electrically-conductive inner sleeve of said at least one first jack of said inner wall of said hollow housing of said first main component and said second main component is in electrical communication with said at least one of said internally-disposed continuous loop alarm circuit of said first main component and said internally-disposed circuit of said second main component.

16. The system as defined in claim 11, wherein said hollow housing of said second main component is constructed of a strong molded plastic.

17. The system as defined in claim 11, wherein said second main component further includes a cable that is replaceably engagable with said hollow housing of said second main component and the second object; said cable of said second main component is in electrical communication with said internally-disposed circuit of said second main component when engaged with said hollow housing of said second main component.

18. The system as defined in claim 17, wherein said cable of said second main component has a strong, flexible insulating material sheath that contains an internally-disposed conducting wire therein, and each of a pair of free ends has disposed thereon an electrically-conductive plug that is in electrical communication with said internally-disposed conducting wire of said cable of said second main component; said electrically-conductive plug of each of said pair of free ends of said cable of said second main component has a circumferentially-disposed groove that is disposed completely around said electrically-conductive plug of each of said pair of free ends of said cable of said second main component.

19. The system as defined in claim 18, wherein said second main component further includes a cable key lock release that is disposed on said hollow housing of said second main component, in proximity to said cable of said second main component; said cable key lock release of said second main component is in electrical communication with said internally-disposed circuit of said second main component.

20. The system as defined in claim 19, wherein said second main component further includes a key for turning said cable key lock release of said second main component.

21. The system as defined in claim 18, wherein said second main component further includes a pair of jacks that are embedded in a pair of throughbore with perimeters in said outer wall of said hollow housing of said second main component; each of said pair of jacks of said outer wall of said hollow housing of said second main component has a non-electrically-conductive outer sleeve that extends inwardly from, and is integral with, a perimeter of a respective throughbore of said pair throughbore of said outer wall of said hollow housing of said second main component; said non-electrically-conductive outer sleeve of each of said pair of jacks of said outer wall of said hollow housing of said second main component has a laterally-oriented throughbore; said laterally-oriented throughbore of said non-electrically-conductive outer sleeve of each of said pair of jacks of said outer wall of said hollow housing of said second main component is in alignment with said circumferencially-disposed groove of said plug of each of said pair of free ends of said cable of said second main component when said plug of each of said pair of free ends of said cable of said second main component is received by a respective jack of said pair of jacks of said outer wall of said hollow housing of said second main component.

22. The system as defined in claim 21, wherein each of said pair of jacks of said outer wall of said hollow housing of said second main component further has an electrically-conductive inner sleeve that extends inwardly from said perimeter of said respective throughbore of said pair of throughbores of said outer wall of said hollow housing of said second main component; said electrically-conductive inner sleeve of each of said pair of jacks of said outer wall of said hollow housing of said second main component is internal to said non-electrically-conductive outer sleeve of a respective jack of said pair of jacks of said second main component; said inner sleeve of each of said pair of jacks of said outer wall of said hollow housing of said second main component has a laterally-oriented throughbore that is in alignment with said laterally-oriented throughbore of said non-electrically-conductive outer sleeve of said respective jack of said pair of jacks of said outer wall of said hollow housing of said second main component; said electrically-conductive inner sleeve of each of said pair of jacks of said outer wall of said hollow housing of said second main component is in electrical communication with said internally-disposed circuit of said second main component.

23. The system as defined in claim 22, wherein said cable key lock release of said second main component is operatively connected to a prong that passes into said laterally-oriented throughbore of said non-electrically-conductive outer sleeve of each of said pair of jacks of said outer wall of said hollow housing of said second main component and said electrically-conductive inner sleeve of said respective jack of said pair of jacks of said second main component; said plug of each of said pair of free ends of said cable of said second main component is securely engaged in said pair of jacks of said second main component by turning said cable key lock release of said second main component and causing said prong of said cable key lock release of said second main component to enter said circumferencially-disposed groove of said electrically-conductive plug of each of said pair of free ends of said cable of said second main component.

24. The system as defined in claim 1; further comprising an indicator light being in electrical communication with said internally-disposed continuous loop alarm circuit of said first main component for indicating when said alarm is armed and in condition to be actuated.

25. The system as defined in claim 1; further comprising a light disposed on said inner wall of said hollow housing of said first main component and being in electrical communication with said internally-disposed continuous loop alarm circuit of said first main component, so that when said first main component and said second main component are separated from each other said light can be detected by a remote camera which can record the unauthorized removal of the first object.

26. The system as defined in claim 1; further comprising a warning device being in electrical communication with said internally-disposed continuous loop alarm circuit of said first main component for warning that the unauthorized removal of the first object is occurring.

27. The system as defined in claim 26, wherein said warning device of said first main component generates at least a signal selected from the group consisting of audible, pager, video camera, still-camera, communication, and satellite.

* * * * *